United States Patent [19]

D'Alessio et al.

[11] Patent Number: 4,481,748

[45] Date of Patent: Nov. 13, 1984

[54] SHORING SYSTEM AND PARTS THEREOF

[75] Inventors: Michael S. D'Alessio, Flushing, N.Y.; Robert S. Safier, Hackensack, N.J.

[73] Assignee: Harsco Corporation, Camp Hill, Pa.

[21] Appl. No.: 298,474

[22] Filed: Sep. 1, 1981

Related U.S. Application Data

[63] Continuation-in-part of Ser. No. 185,761, Sep. 10, 1980.

[51] Int. Cl.[3] ..... E04G 1/12

[52] U.S. Cl. ..... 52/638; 182/178; 182/179

[58] Field of Search ..... 182/178, 179; 52/637, 52/638, 639; 248/188.2, 188.4, 354 R, 354 P, 354 L

[56] References Cited

U.S. PATENT DOCUMENTS

| | | | |
|---|---|---|---|
| 3,650,078 | 3/1972 | Jenning | 52/646 |
| 3,802,148 | 4/1974 | Heidrich | 52/295 |
| 4,026,079 | 5/1977 | Morris | 182/179 |
| 4,205,497 | 6/1980 | Schirm | 52/731 |

FOREIGN PATENT DOCUMENTS

| | | | |
|---|---|---|---|
| 808226 | 7/1951 | Fed. Rep. of Germany | 248/354 R |
| 1033856 | 7/1953 | France | 248/354 R |
| 643898 | 8/1962 | Italy | 248/354 P |
| 357110 | 3/1930 | United Kingdom . | |
| 629115 | 9/1949 | United Kingdom . | |
| 882801 | 7/1958 | United Kingdom | 248/354 R |

*Primary Examiner*—Reinaldo P. Machado
*Attorney, Agent, or Firm*—Curtis, Morris & Safford

[57] ABSTRACT

A shoring system having base frames with legs preferably of extruded aluminum in oval cross-section (for optimal support with minimal use of materials) and optionally having three T-slots formed integrally therewith and extending the length thereof (for versatility in bracing), and preferably in combination with telescoping extension frames formed of extruded aluminum and adjustably inter-connected with respective uppermost base frames by U-pins (or channeled load collars) fastened through pairs of locating holes (or dual slots) spaced along each extension frame leg. The locating holes (or slots) are formed in thickened walls on either side of a central hollow core in each extension frame leg (to accommodate retraction of a jack screw mounted on the leg).

9 Claims, 21 Drawing Figures

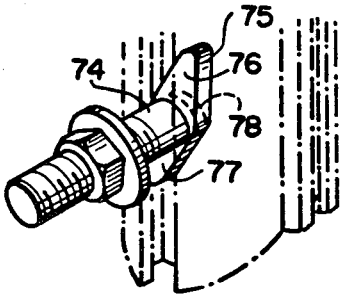
FIG. 13
FIG. 1
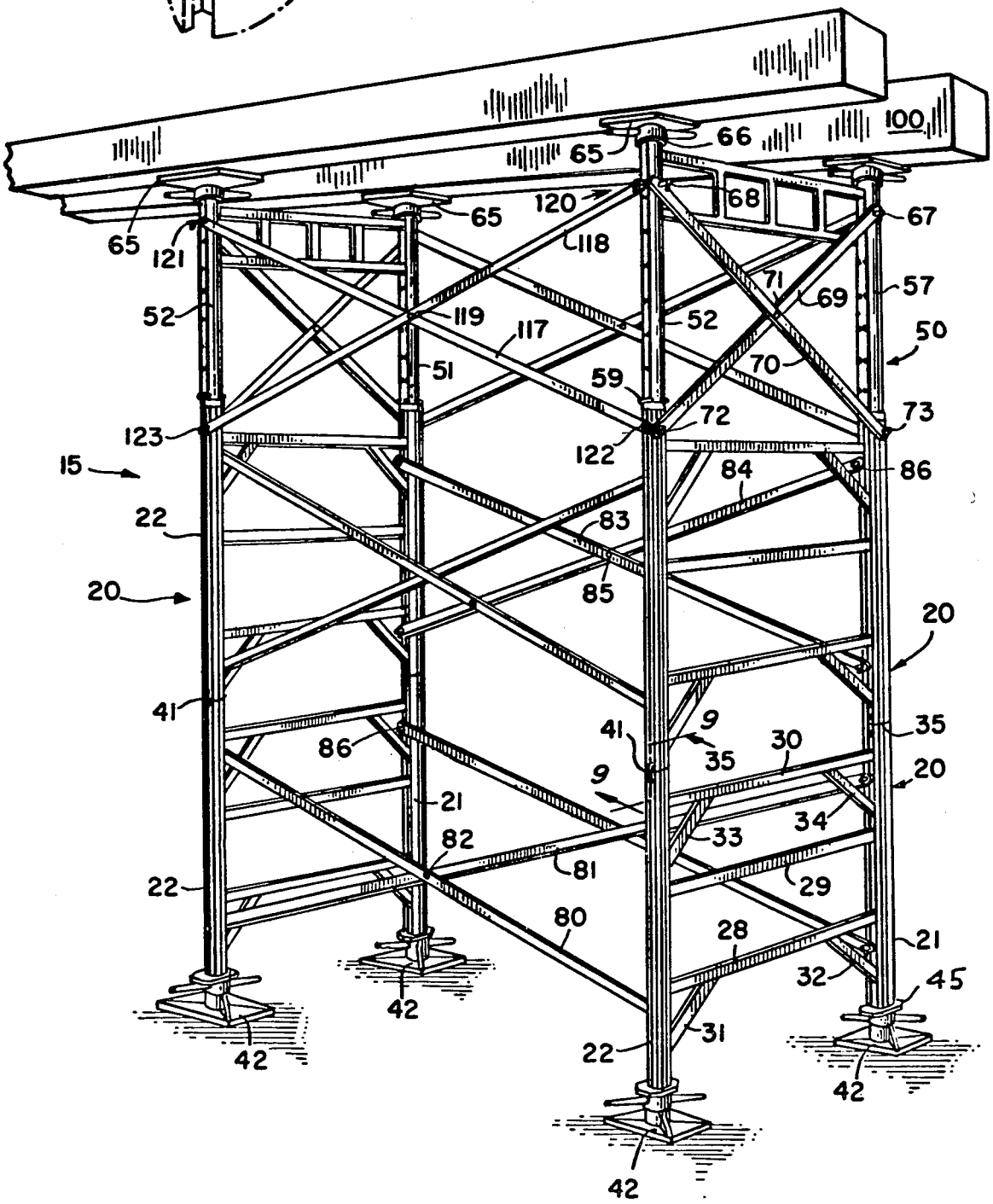

4
65
66
53
66
65
51
52
120
68
55
50
57
67
56
54
70
69
118
71
30
79
34
4
33
123
79
72
73
81
27
27
29
79
80
28
10
10
25
23
26
86
11
11
31
32
8
22
21
24
49
49
42
48
48
8

65
66
68
70
73
41
41
86
27
22
80
81
82
65
52
60
66
67
69
72
95
94
93
35
27
22
15
15
65
66
60
81
27
22
65
66
60

SHORING SYSTEM AND PARTS THEREOF

This is a continuation-in-part application of pending application Ser. No. 185,761, filed Sept. 10, 1980.

The present invention relates to an improved shoring system and unique components therefor, also including extendable shoring, where more particularly the major components are preferably made of aluminum for lightness with strength and labor-saving ease of handling and assembly. Such shoring structures are of the general type commonly used in construction and other related industries.

BACKGROUND OF THE INVENTION

Conventional shoring is made from stock steel tubing having a circular cross-section of uniform thickness. The shoring frames and accessories are typically constructed by welding or mechanical fastening. The frames are cross-braced for assembly into support towers or the like. An example of such shoring, adapted for use with extendable frames, is illustrated in U.S. Pat. No. 3,190,405, issued June 22, 1965. Upper and lower jack screws of conventional use are also shown. These are used for their levelling, form-fitting, and stripping capabilities.

Aluminum has had some increasing use in the industry, although usually limited to special application scaffolding, flying shoring, or stationery joists. Aluminum is desirable because of its light weight and non-corrosiveness; but is generally too costly.

Thus, it is an object of this invention to develop a shoring system made primarily from an extrudable lightweight material of adequate strength and yet be competitively priced, given its advantages.

A further object of the present invention is to provide extendable shoring made from aluminum or similar material and yet still be capable of essentially infinite adjustability and full-load capacity.

A still further object of the present invention is to make maximum effective use of a minimum of material to minimize weight and material costs without reducing load capacity.

BRIEF DESCRIPTION OF THE INVENTION

According to a preferred embodiment of the present invention, the legs of the shoring base frames are made from an extruded hollow aluminum tube having a somewhat elliptical or even rectangular cross-section. Preferably, the major axis of such cross-section is approximately twice the minor axis, and the minor axis lies in the plane of the base frame. These dimensions can vary, as will be understood by one of ordinary skill in this art, in view of the disclosure herein as the structure of the base frames and their braces vary.

Applicants have uniquely recognized that the universally accepted circular cross-sectional tubing having uniform wall thickness, as used in the legs employed in conventional shoring, is an inefficient use of material. In such conventional shoring, the frame construction and bracing techniques result in uneven columnar support for such legs.

As explained more fully below, this results in more material being needed in one horizontal axis to give adequate rigidity to support a given load than is needed in the horizontal axis perpendicular thereto. By making the frame leg of an elliptical, rectangular, or preferably similar symmetrical non-circular shape, the uniform thickness of the walls of the legs can be substantially reduced without reducing the rated capacity. Since such a shape can be readily extruded, the Applicants' discovery has resulted in both a reduction in cost and in the amount of material used. This saving in both cost and weight gives a premium product which is more competitively piced than was previously possible (especially when combined with the other improvements disclosed herein).

Alternatively, the Applicants can achieve much the same result with a circular cross-section, but of a non-uniform thickness, wherein the wall thickness of the leg in the plane of the frame is substantially less than the wall thickness of that leg in the vertical plane which is perpendicular to the frame and which includes the central axis of the leg.

Of course, it is within the scope of this invention to combine both a variation in the wall thickness and in the shape of the base frame legs, according to this disclosure, to achieve the desired even columnar support. This combination is found in the illustrated extension frame legs described next.

Another aspect of preferred embodiments of the present invention concerns a telescoping extension stanchion. Such stanchions can be used alone, or most commonly in pairs to form the leg portion of extension frames. For simplicity of description, a single stanchion will initially be described. A stanchion preferably is made of a hollow extruded aluminum tube with a cross-sectional shape in the form of a modified oval and with substantially thicker walls in the direction of the major axis. It is adapted to fit telescopically within a respective base frame leg. It has locating holes, preferably in horizontal pairs, spaced along its length. These holes respectively pass through each of the two thickened walls which occur on either side of a central hollow core. The support pins for the locating holes are advantageously formed as a single U-shaped pin. In use, the legs of this dual pin are offset from the central hollow core and thus function to permit a jack screw set in the upper end of the stanchion to clear the pin when the jack screw and the stanchion are both in their retracted position within the base frame. In addition to this unique advantage, the dual pin also serves to spread the load transference between the stanchion and base frame leg and to avoid hole elongation problems when these are made of aluminum, magnesium or other lightweight and relatively soft extrudable material. To further avoid this problem, the top of the leg of the base frame carrying the stanchion is fitted with a load-collar seat (or support plate). This plate distributes the load evenly over the walls of the base frame leg.

In a broader aspect of this invention, the telescoping stanchion can fit over the base frame leg (see U.S. Pat. No. 3,527,320) and still retain the co-action of a dual support pin.

Similarly, the extension support pins can be two or more. The hollow core of the extension leg could be off-set so that the thickest wall portion is only on one side with the locating holes vertically aligned therein to function with a cooperatively drilled and aligned bearing collar seat.

In an improved embodiment of the extension stanchion, the pairs of locating holes are alternatively formed as pairs of openings in the form of slots (perferably in dual pairs) cut in the sides of the thickened wall. This has the surprising advantage of significantly reducing the wall thickness required for the extension stanchion (e.g. the thickness necessary to have the same load rating as the corresponding base frame leg). This significant change enables the weight of the stanchion to be reduced from 4.45 lbs./ft. (for the aforementioned design with pairs of holes) to 3.2 lbs./ft (for the improved design with dual pairs of slots). This reduces the weight of a 5 foot extension frame from 60 lbs. to 44 lbs. (obviating the need for a special 4 foot 42 lb. Extension frame and for corresponding special 4 foot base frames; otherwise needed because 60 lb. frames are too heavy to be easily handled on the job site).

In this improved design, a U-shaped load collar is used in lieu of the aforementioned U-shaped pin. The arms of the collar are formed as inward-facing U-channels. The rails of the U-channels fit in corresponding transverse slots cut in the sides of the extension stanchion; whereby the load from the stanchion is transferred from the bearing surface of the slots, through the collar and the respective load-collar seat, to the respective base frame leg. By adjusting the number and depth of the slots, it is possible to achieve the required bearing area needed for load transfer essentially without the need for increasing the thickness of the remainder of the stanchion wall beyond that needed for the normal columnar loading capacity. In contrast the cross-sectional area of the holes in the pin-supported stanchion represent a much larger vertically-oriented dead weight volume in the wall thickness (which does not contribute to the columnar loading capacity of the stanchion). Even using dual pairs of pins (with each pair seated vertically spaced in holes oriented similarly to the spacing of the dual pins of the slots) do not significantly descrease the excess wall thickness of the extension leg. On the other hand, some further decrease in wall thickness can be achieved in the improved design by increasing the number of pairs of slots to 3 or more (but the load collar becomes more complicated and the tolerances more critical). The load collar seat is advantageously formed with "confining" legs (cut partially free from each corner of the flat steel plate from which the seat is made, and bent upwardly from the upper face of said seat). These legs serve to engage the arms of the load collar and to prevent them from spreading apart.

Other similar modifications within the scope of Applicants' invention will occur to those skilled in this art.

In combination with the foregoing, the Applicants' preferred embodiments of the present invention include an improved aluminum shoring system employing T-shaped grooves formed along along the length of the base frame legs for use in bolting bracing and accessories to such legs with infinite adjustability. As specifically illustrated and described below, the base frame legs are oval in shape.

A T-slot is formed in each of the three free sides of each leg. A common machine bolt of proper size can be used to function with the T-slot (with the head captured in the groove ahd the shank extending out). Alternatively, an improve twist-lock bolt can be used (see FIGS. 14 and 11 below and Co-Worker's Copending U.S. application Ser. No. 231,493 filed Feb. 4, 1981). The twist-lock bolt has the advantage of (1) being insertable anywhere along the slot (not just from the slot end), (2) having an elongated head to spread the load from the bolt over a larger area of the relatively soft metal forming the T-slot and (3) optimally, being positively positioned along the T-slot by co-action with positioning holes drilled at spaced intervals along the base of the T-slot.

In this specification and the accompanying drawings, we have shown and described a preferred embodiment of our invention and have suggested various alternatives and modifications thereof, but it is to be understood that these are not intended to be exhaustive and that many other changes and modifications can be made within the scope of the invention. These suggestions herein are selected and included for purposes of illustration in order that others skilled in the art will more fully understand the invention and the principles thereof and will thus be enabled to modify it and embody it in a variety of forms, each as may be best suited to the conditions of a particular use.

BRIEF DESCRIPTION OF THE DRAWINGS

In the accompanying drawings, a preferred embodiment of the present invention is shown in which essentially all of the elements (part from screw jacks, braces, and pins) are made of aluminum; in which like reference numerals indicate like parts;

FIG. 1 is a vertical perspective view showing the preferred aluminum shoring system in the form of a single tower with two vertically stacked base frames and an extension frame for the upper one of the base frames, with an adjacent pair of stacked base frames interconnected by side cross braces, and with the extension frame of the base frames stiffened in the extended position by end cross braces and by side cross braces, with screw jacks being fitted to the bottom of each leg of the bottom base frame and to the top of each stanchion of the extension frames, and with stringers supported by the jacks of the extension frames;

FIG. 13 is an enlarged detail of a modified T-shaped bolt, also shown in FIG. 11, for use in connecting and fixing cross bracing to specific positions on the base frame leg;

FIG. 14 is a cross-sectional view of the improved extension frame leg taken on line 14—14 of FIG. 16 (also showing in phantom outline an alternative embodiment of the corresponding generally symmetrical base frame leg);

FIG. 15 is an enlarged side elevational view in partial section of detailed portions of the extension frame leg of FIG. 16;

FIG. 16 is a front elevational view of the improved extension frame (showing a screw jack in phantom outline on one of the extension legs);

FIG. 17 is a plan view of the extension frame of FIG. 16;

FIG. 18 is a plan view of the extension frame load collar;

FIG. 19 is a plan view of a load collar seat; and

FIG. 19A is a side elevational view of the load collar of FIG. 19.

In FIG. 1 is shown as a preferred embodiment, an aluminum shoring system in the form of a shoring tower 15.

Figure 2:
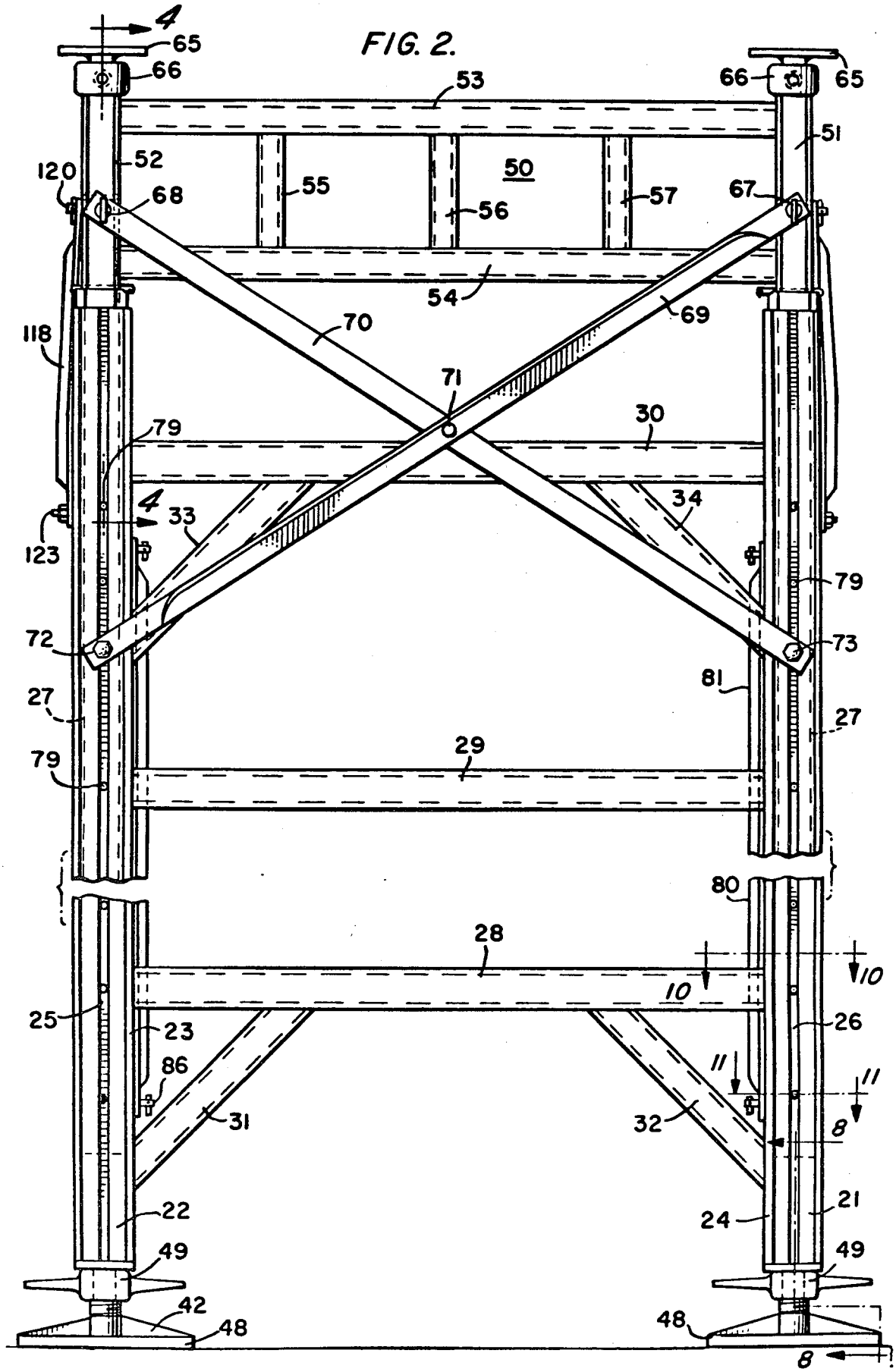
FIG. 2 is an enlarged view as seen from the right in FIG. 1, but showing the extension frame in the lowered position.

This comprises vertically stacked pairs of cross-braced base frames 20 topped by a pair of cross-braced extension frames 50. Levelling jack screws 42 in the bottom-most base frame legs 21, 22 and fine height adjustment jack screws 64 in the top of the extension frame legs 51, 52 are provided as needed.

Figure 3:
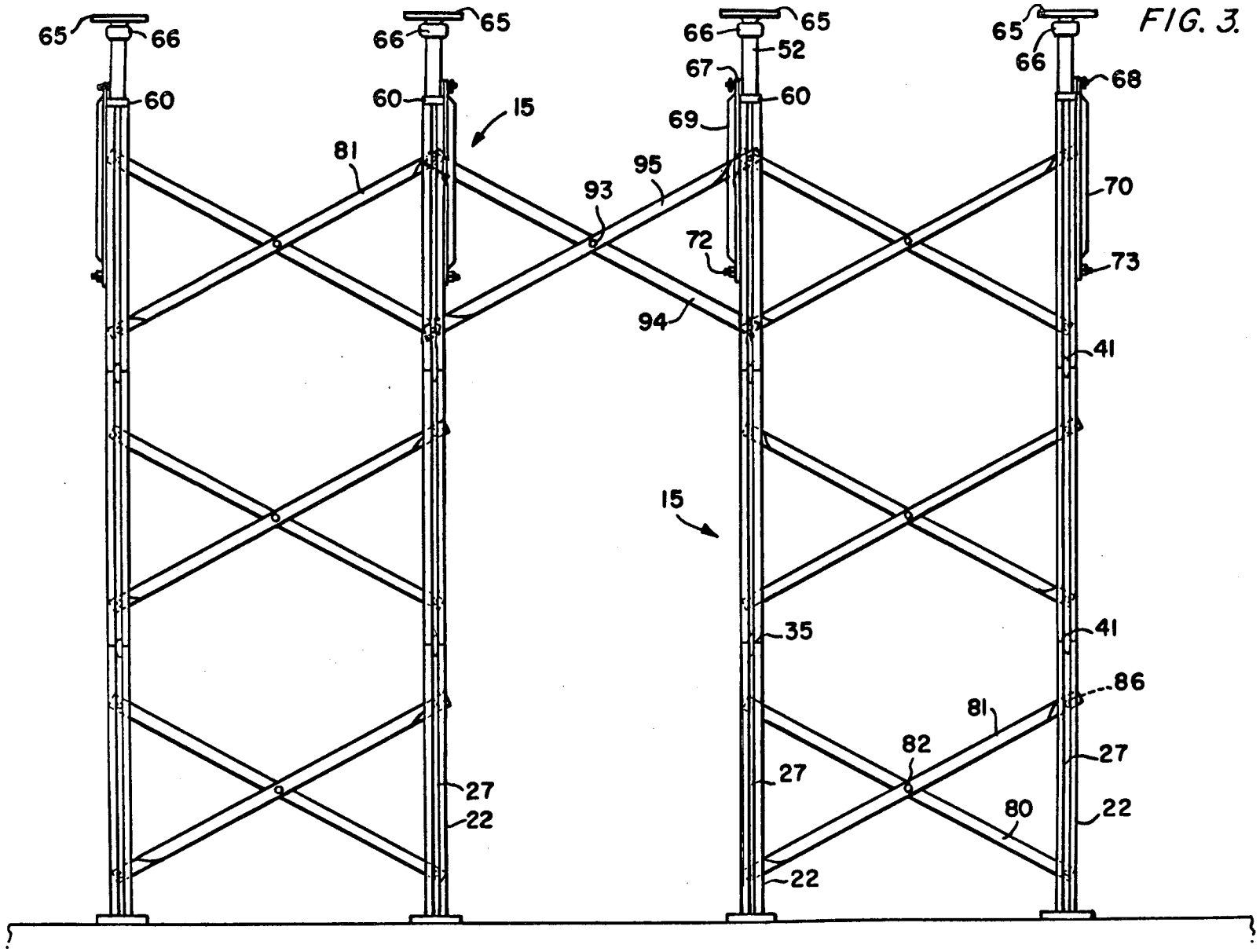
FIG. 3 is a side view of structure similar to FIG. 2 showing a plurality of spaced base frames and extension frames forming two interconnected towers.

For purposes of illustration, only two pairs of base frames are shown, but many more, as needed for a particular job, can be vertically stacked. The vertical stacking of base frames may be limited only by load capacity rating and the need for supplemental bracing, as required by increased height. As shown in FIG. 3, a plurality of towers 15 can be erected both longitudinally and transversely and braced together as needed for mutual stability. (See braces 94 and 95).

Figure 10:
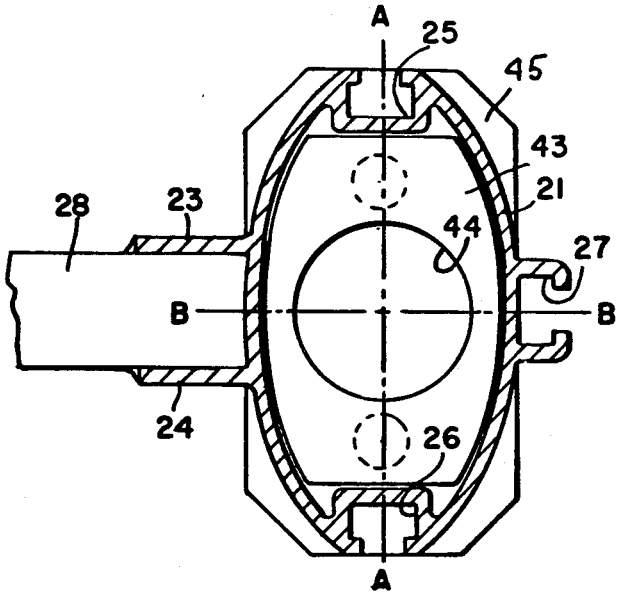
FIG. 10 is a cross-sectional view of a base frame leg taken on line 10—10 of FIG. 2.
Figure 11:
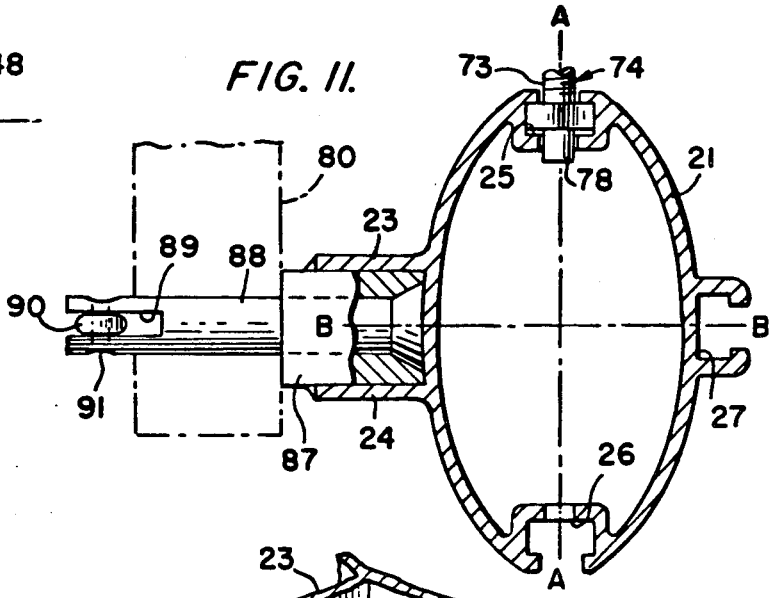
FIG. 11 is a cross-sectional view of a base frame leg taken on line 11—11 of FIG. 2.

Each base frame 20 comprises spaced parallel legs 21 and 22. Each leg is an extruded hollow aluminum tube of oval cross-section having a major long axis A—A and at right angles a minor short axis B—B (as best seen in FIGS. 10 or 11). Integrally formed along one broad side of each base frame leg are spaced sacrificial flanges 23 and 24 (parallel to the axis B—B). On the opposite side of each leg 21 and 22 is an integral T-slot 27.

Figure 14:
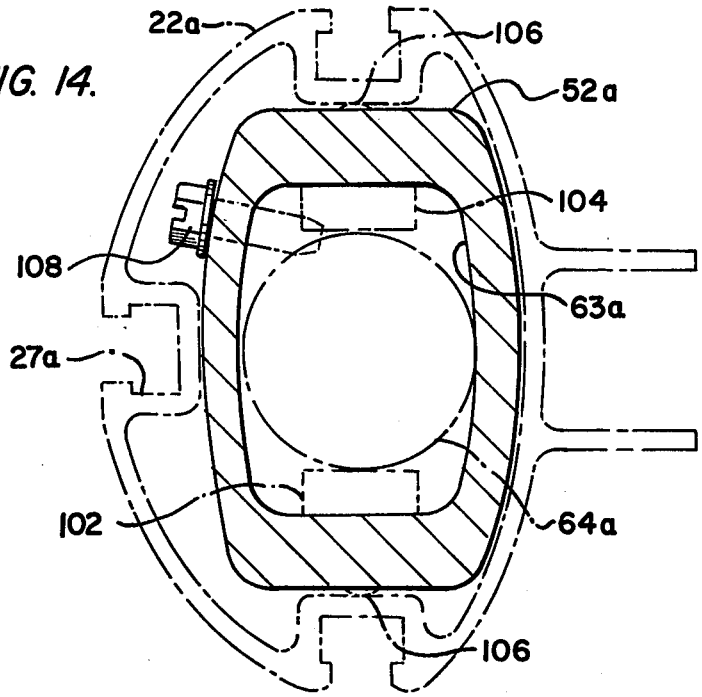
FIGS. 14 to 19A show an improved alternative preferred embodiment of the present invention.

This T-slot may be formed as a raised channel 27 (in the form shown in FIG. 10) or preferably as a depressed channel **27*a* (in the form shown in FIG. 14). Oval leg 21*a* has been modified slightly from the more symmetrically shaped let 21 in order to better protect the sides of the channel forming the T-slot 27*a* from damage due to typical rough handling on the job site. This increased effective diameter also gives a small increase in the strength of the leg 21*a*** with little or no increase in the amount of material needed to form the leg.

Diametrically opposed T-slots 25 and 26 (in the axis A—A) are integrally formed in the remaining two sides of each leg. Each illustrated base frame 20 further includes cross supports in the form of spaced horizontal parallel struts 28, 29 and 30, whose ends are mounted between flanges 23 and 24 and welded thereto.

Use of sacrificial flanges 23 and 24 for welding to avoid impairing the load-carrying capacity of the legs 21 and 22 is more fully disclosed and claimed in the Copending U.S. application Ser. No. 187,520, filed Sept. 15, 1980 by one of the Applicants. The base frame 20 is further braced by diagonal struts 31 and 32 (each having the lower end thereof welded to flanges 23 and 24 of the respective legs 21 and 22 and having their upper ends welded to horizontal strut 28) and by diagonal struts 33 and 34 (similarly welded between respective flanges 23 and 24 and horizontal strut 30). Within the scope of this invention, the base legs 21 and 22 may be joined by an effective alternative permanent bracing in place of struts 28 to 34.

Figure 9:
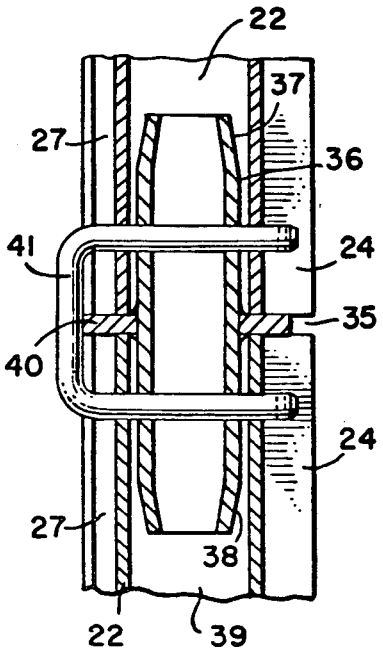
FIG. 9 is a sectional view on line 9—9 of FIG. 1 showing the bayonet-type connection between stacked base frames utilizing an optional U-shaped pin for vertically connecting adjacent base frame legs.

The vertically stacked base frames 20 are interconnected at the joint 35 by a bayonet-type connector 36 (shown in cross-section in FIG. 9).

The connector 36 is preferably formed of a short hollow extruded aluminum tube whose ends 37 and 38 have been tapered for ease of insertion in the lower core 39 of the base frame leg. A washer-like plate 40 is welded to the connector 36 to extend between the abutting ends of the stacked adjacent base legs 22. The assembly is secured into position by conventional toggle pins; or optionally by a single U-spaced pin 41. These extend through aligned holes in the walls of the legs and through connector 36, as shown. Pin 41, if used, preferably would be identical to pin 59 described below.

Figure 8:
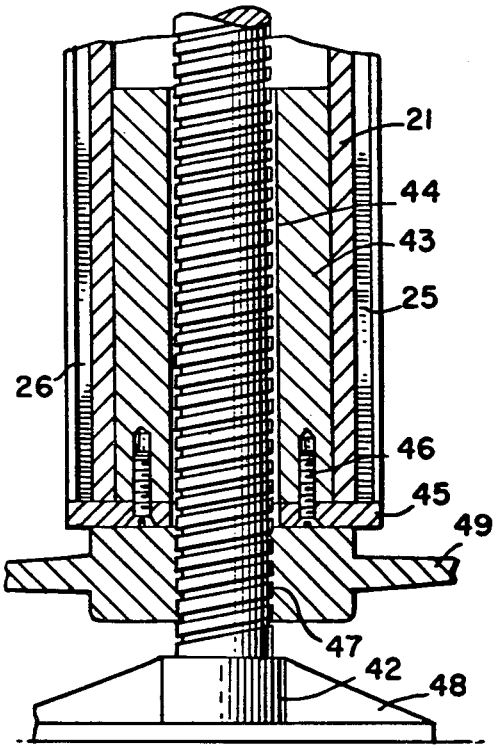
FIG. 8 is an enlarged detail in cross section on line 8—8 of FIG. 2 of a screw jack mounted at the bottom of a base frame leg.

A screw jack generally indicated at 42 is typically mounted in the lower end of each of legs 21, 22, as seen in detail in FIG. 8. As there shown, an aluminum block 43 having a central core 44 is suitably secured therein by end plate 45 and screws 46. A screw post 47 having a foot 48 extends into core 44. Adjustment is made by hand nut 49 mounted on screw post 47 and engaging underplate 45. Block 43 is shown in FIG. 10, but is omitted from FIG. 11.

As noted above, an extension frame is telescopically mounted in the upper end of the legs of the upper base frame (best seen in FIG. 2). The extension frame is generally indicated at 50. It comprises a leg (or stanchion) 51 which telescopes into base frame leg 21. The second leg 52 telescopes into the upper end of the base frame leg 22. Stanchions 51 and 52 are separated by spaced horizontal struts 53 and 54 welded at the ends thereto and further strengthened by vertical spacers 55, 56, and 57 welded in position between struts 53 and 54. The several strut spacers are hollow for lightness. As with the base frame 20, the struts 53 to 57 can be substantially varied without departing from the scope of the invention.

Figure 4:
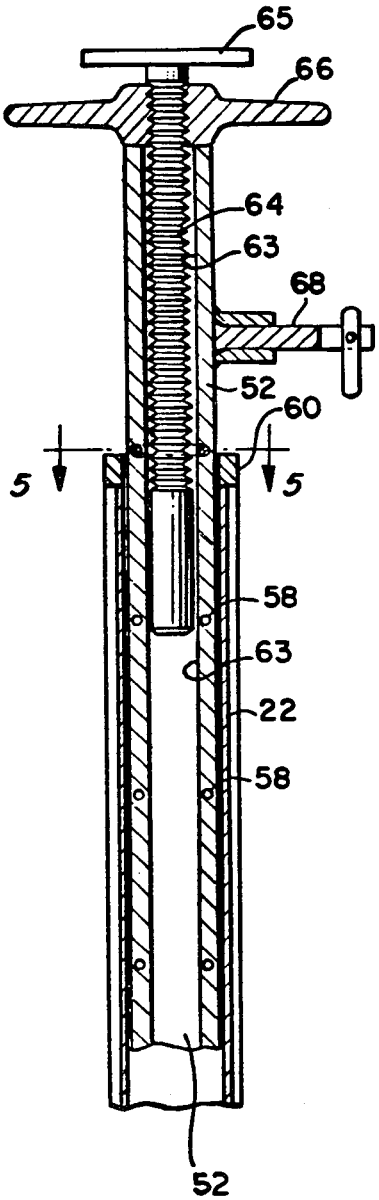
FIG. 4 is an enlarged detail on the line 4—4 of FIG. 2 of the screw jack in cross section mounted in the top of a stanchion of an extension frame.
Figure 5:
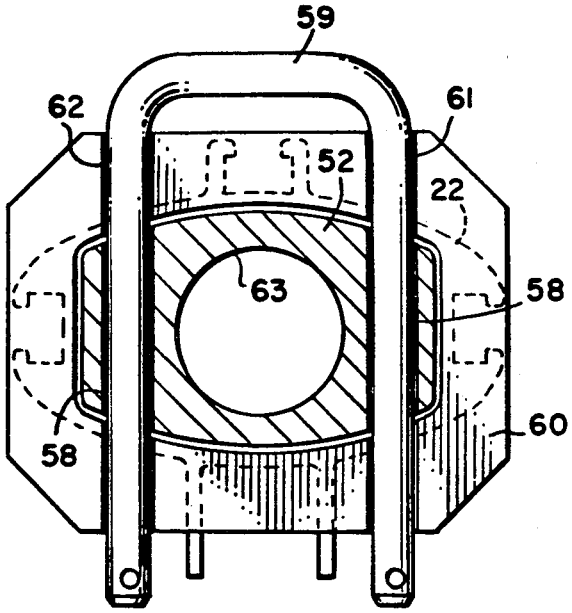
FIG. 5 is a cross-sectional view in part, showing the U-shaped pin utilized for supporting a stanchion of an extension frame in extended position.
Figure 6:
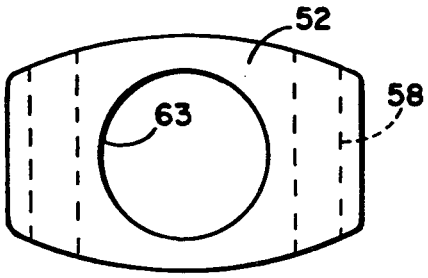
FIG. 6 is an end view of an extension frame stanchion.

As best seen in FIGS. 4 and 5, each extension stanchion 51 or 52 has a plurality of spaced pairs of locating holes 58 drilled through the walls thereof, preferably on either side of the hollow core 63. Standard support pins, or preferably a single U-shaped pin 59, fits through a pair of locating holes 58 to support the stanchion 51 or 52 in the desired extended position on the respective base frame leg 21 or 22 from which it telescopes. A support plate 60 rests upon the upper end of the base frame leg 21 or 22 and engages the pin 59 positioned in and extending from either end of appropriate locating holes 58 of the stanchion 51 or 52. Plate 60 may be grooved as at 61 and 62 to receive the legs of pin 59. Plate 60 protects the ends of the legs 21 and 22 and makes feasible thinner-walled base legs, by spreading the load from the pin 59.

Each extension 51 or 52 has a hollow axial core 63 which freely accommodates a jack screw 64 positioned at its upper end. A hand nut 66 is mounted on screw 64 and engages the upper end of the extension stanchion for movement of plate 65. This gives fine vertical adjustment for the height of the shore.

In FIGS. 14 to 19A is described a lighter-weight and less costly preferred embodiment of the extension frame and its related equipment. The frame 50*a* has slots 58*a'* and 58*a''* (in lieu of the holes 58) cut in the thick side walls of the stanchions 51*a* and 52*a*. The slots cooperate with the rails 61*a'* & 61*a''* and 62*a'* & 62*a''* of the load collar 59*a* to transfer the load on the respective stanchion 51*a* or 52*a* to the load collar seat 60*a*.

The design of the channeled load collar 59*a* and slots 58*a'* or 58*a''* permit the wall thickness of the extension stanchion made of an aluminum alloy (or similar lightweight metal) to be considerably thinned, with a direct saving in weight and cost (and an indirect saving in labor and equipment costs due to ease of handling and to a reduction in the number of frame sizes required). With thinner walls in the stanchions, it becomes necessary to add a pair of short filler strips 102, 104 (shown in FIG. 15 and superimposed in dotted outline in FIG. 14). These strips 102, 104 are fastened in the upper end of each stanchion 51*a* or 52*a*. The strips 102, 104 are secured in place by blind rivets 106.

Figure 15:
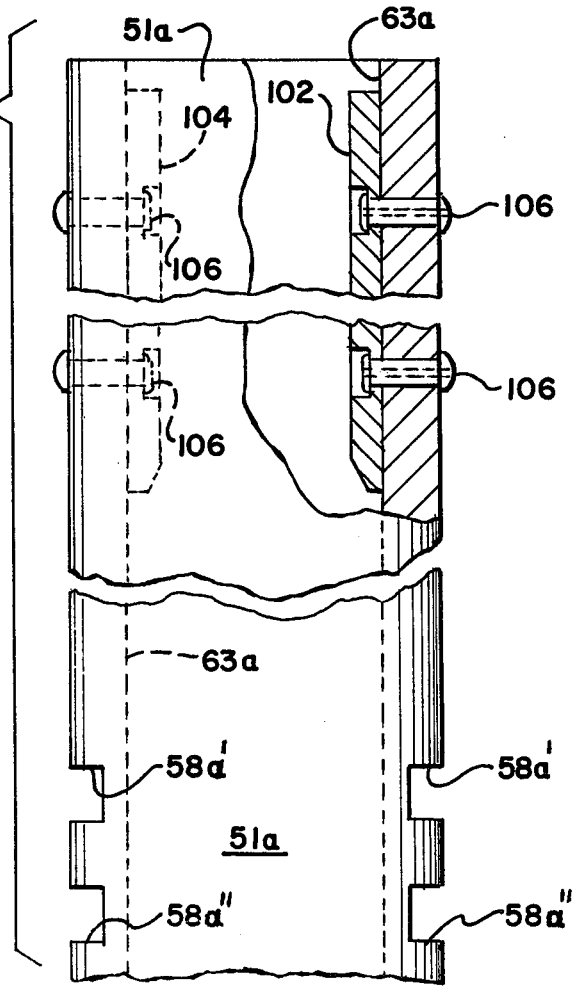
Figure 17:
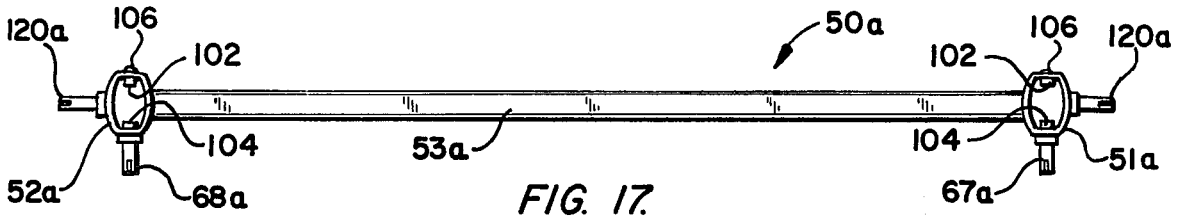

By reference to FIG. 14 and the bottom of FIG. 15 it will be seen that if one takes a cross-section through the extension leg 52*a* at the level of the slots 58*a'* or 58*a''*, the leg 52*a* has essentially a uniform wall thickness.

In practice, a load collar seat 60*a* is slipped on the free end of each leg 51*a*, 52*a* of the extension frame 50*a* (see FIG. 16), and is retained thereon by a screw 108. The load collar 59*a* is loosely fastened to the seat 60*a* by cable 110. The seat 60*a* has positioning legs 112 partially stamped out from the corners of the steel plate forming said seat, In operation, with the extension frame 50*a* positioned at the desired height on a base frame 20 or 20*a*, the seats 60*a* rest on the tops of the uppermost base from legs 21, 22 or 21*a*, 22*a* and collars 59*a* positioned across said respective legs with the rails 61*a'* 61*a''* engaging slots 58*a'*, 58*a''* and the collars 59*a* resting on respective seats 60*a*. The seat legs 112 prevent the arms 61*a* and 62*a* of collar 59*a* from spreading. Fine height adjustment can be made with appropriate jack screws 64*a*. As an aid to assembly, the hole 114 is drilled through the free ends of one pair of rails 61*a'*, 61*a''* to receive a nail (and prevent the collar 59*a* from slipping off the leg of 51*a* during assembly handling—see the collar 59*a* and its seat 60*a* operatively positioned on leg 51*a* in FIG. 16).

Figure 7:
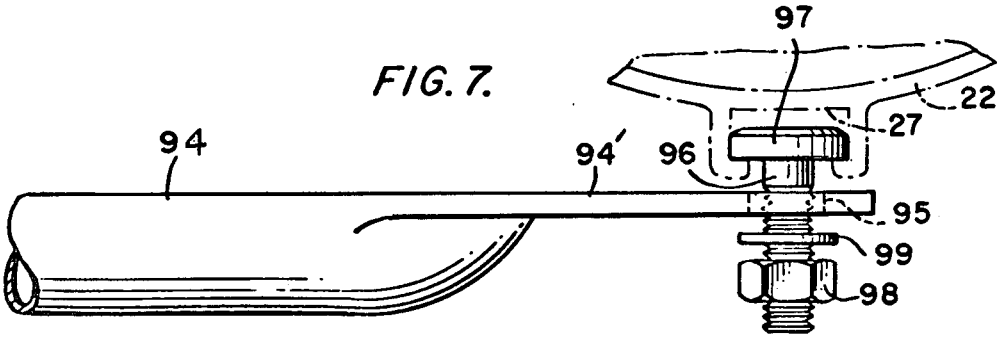
FIG. 7 is an enlarged detail showing one manner of connecting a side cross brace and a base frame leg via a bolt in a T-slot of the latter.

A toggle-type bolt 67 is secured in stanchion 51. A similar type of bolt 68 (FIGS. 2 and 4) is secured to stanchion 52. These receive and hold the upper ends of end cross braces 69 and 70, respectively. Cross braces 69 and 70 are pivotally connected at 71. The lower ends of cross braces 69 and 70 are provided with T-shaped bolts 72 and 73. Bolts 72 and 73 are mounted respectively in T-slots 25 and 26. Conventional bolts as shown in FIG. 7 may be used.

A preferred embodiment for the structure of bolts 72 and 73 is shown in detail in FIG. 13. The bolt has a screw thread 74 and a T-shaped head 75 of a suitable width to enter slot 25 or 26. The head of the bolt 75, instead of being circular (or even rectangular), has been cut away to form a parallelepiped so that the undersurfaces 76 and 77 of the bolt head 75 provide an extended load surface to spread the load from the bolt along a broader area of the lip of the T-slot to which the bolt is fastened. See the aforementioned Ser. No. 231,493, for alternative detail. The surfaces 76 and 77 engage the lips of the T-slot upon rotation of the head 75 into the illustrated locked position within the groove. The bolt optionally may be optionally extended as at 78 (see also FIG. 11) to enter a selected one of cooperative spaced holes 79 bored through the wall of the stanchion at the bottom of the T-shaped groove to prevent slipping of the bolt during locking movement in the groove and also to give more positive positioning.

Figure 12:
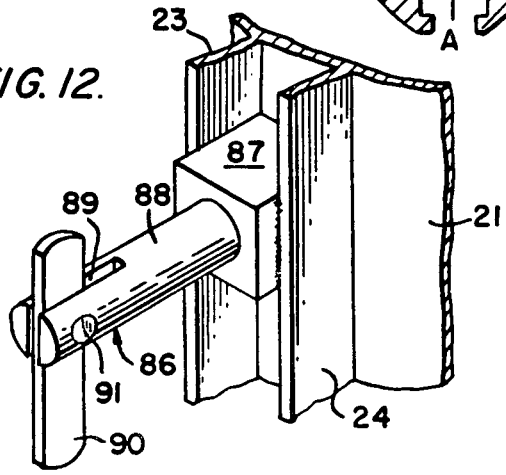
FIG. 12 is an enlarged detail of a toggle-type stud connection fixed in an aluminum mounting block welded to a base frame leg by means of sacrificial flanges thereon, said stud intended for securing base frame side cross braces to said leg.

As seen in FIG. 1, standard steel base frame side cross braces 80 and 81, pivotally interconnected at 82, extend between adjacent base legs 22. Similarly, base frame side cross braces 83 and 84, pivotally connected at 85, extend between adjacent base legs 21. The ends of side cross braces 80, 81, 83, and 84 are connected to he adjacent base frame legs by a toggle-type connection generally indicated at 86 and seen in detail in FIG. 12. This connector comprises an aluminium block 87. The block is welded in place to flanges 23 and 24. A steel stud 88 fits into a counter-sunk hole through block 87. This avoids the problem of welding steel to aluminum. The toggle-stud 88 may then be conventionally provided with a slot 89 in which key 90 is pivoted at 91. The ends of the cross braces are suitably drilled to slip over the stud 88 when the key 90 is turned in axial alignment and are then locked in position by rotation of key 90 in the position as shown in FIG. 12.

Further, as seen in FIG. 1, extension side frame cross braces 117 and 118, pivotally connected at 119, extend between adjacent stanchions 52 and similar side cross braces extend between extension stanchions 51. The upper ends of braces 117 and 118 are connected to the adjacent extension stanchions at 120 and 121, respectively, by a toggle-type connection as above described with respect to FIG. 12. The lower ends of braces 117 and 118 are secured to the adjacent base stanchion by a T-shaped bolt 122, 123 (see FIG. 13 discussed above) and mounted thereby in adjacent T-shaped slot 27. Thus, when bolts 122 and 123 are tightened, the entire shoring system becomes a unitary rigid whole. With additional bracing, it can also be made capable of movement by being rolled or flown as a unit to another location for further use.

A plurality of shoring units of the type shown in FIG. 1 may be interconnected as shown in FIG. 3 to provide a lengthened shore. The individual shoring towers are joined together by side base-frame cross braces 94 and 95 pivotally interconnected at 93. The ends of said braces 94 and 95 are usually secured to studs 86 of the respective adjacent base frame legs. However, if the spacing between the towers is not of a standard length, then the use of the T-slot 27 permits the contractor to make use of commonly available standard length bracing. Similar end bracing fixed in T-slots 25 or 26 can be used to join adjacent towers in the transverse direction for a widened shore.

The various cross braces can be fastened in T-slots by the T-bolt 72 or 73 or, alternatively, by the conventional machine bolts illustrated in FIG. 7. The ends of the brace, such as 94, are flattened as at 94' and provided with an aperture 95 to receive a threaded bolt 96, the head 97 of which is shown as mounted in slot 27. Nut 98 and optional washer 99 mounted on the threads of bolt 96 secure the cross brace to the leg 22 in the desired position.

As described above, the jack screws at the upper end of the extension frame are provided with plates 65.

These are shown supporting wooden stringers 100 as seen in FIG. 1.

Having described the specific shoring structure, one can now consider in more detail the reasons behind Applicants' discovery of the advantages in the claimed cross-sectional configuration of the base frame legs. The dimensions of the illustrated base frame 20 are typically six feet high by four (or two) feet wide. The spacing between struts 28 & 29 and 29 & 30 is approximately two feet. The toggles 86 are spaced in pairs about four feet apart along each base leg 21 or 22. From this it can be seen that the base frame legs are supported in one direction every two feet and in the other direction only every four feet. Consequently, the Applicants have uniquely recognized that for the illustrated base frames, legs 21, 22 need only about half the lateral strength in the plane of the frame as that needed perpendicular thereto.

Applicants have obtained this differential in lateral strength (with a consequent saving in unneeded material) by making the major axis of the elliptical cross-section of legs 21, 22 about twice the minor axis (see FIGS. 10 and 11).

It will be readily understood that variations in the construction of base frames, and how they are braced, will govern the optimum shapes of the leg cross-section (all within the scope of this invention.

The shoring system as described above is readily assembled because of the light weight of its components (due both to design and material) and because of the ease and flexibility of use of its connecting elements. The base frame units 20 are usually erected and braced in the conventional manner (with side cross bracing 80, 81 and toggle-bolts 86). Additional base frame 20 may be vertically mounted on the lower base frames 20 and locked in position by the bayonets 36 and pins 41. The light weight of the base frame makes it easy for one man to position the frame 20. When the desired height is approximately reached, extension frames 50 are telescopically positioned on adjacent base frames 20 and fixed in place by U-shaped pins 59 (which pins pass through the appropriate pair of locating holes 58 in the extension legs 51, 52 and rest on support plates 60). Extension frame end cross braces 69 and 70 are then mounted at one end on toggle-bolts 67 and 68 and secured at the other end in T-slots 25 or 26 of base frame legs by bolts 72 and 73. Extension frame side braces 117 and 118 are similarly mounted on toggle-bolts 120 and 121 and locked to the adjacent base frame stanchion by bolts 122 and 123 mounted in T-slots 27. The shoring system is thereby interconnected into a unitary whole which may be levelled by the base jack screws 42 with final adjustment of position of the stringers 100 by the extension jack screws 54.

A comparison of FIGS. 1 and 2 shows the extension frames 50 in the extended and retraced positions, respectively.

The three T-slots 25, 26, and 27 on each base frame leg 21, 22 serve primarily to brace extension frames 50. However, the T-slots also provide great flexibility in supplemental or alternative bracing within or between towers 15 and for attaching accessories.

Figure 16:
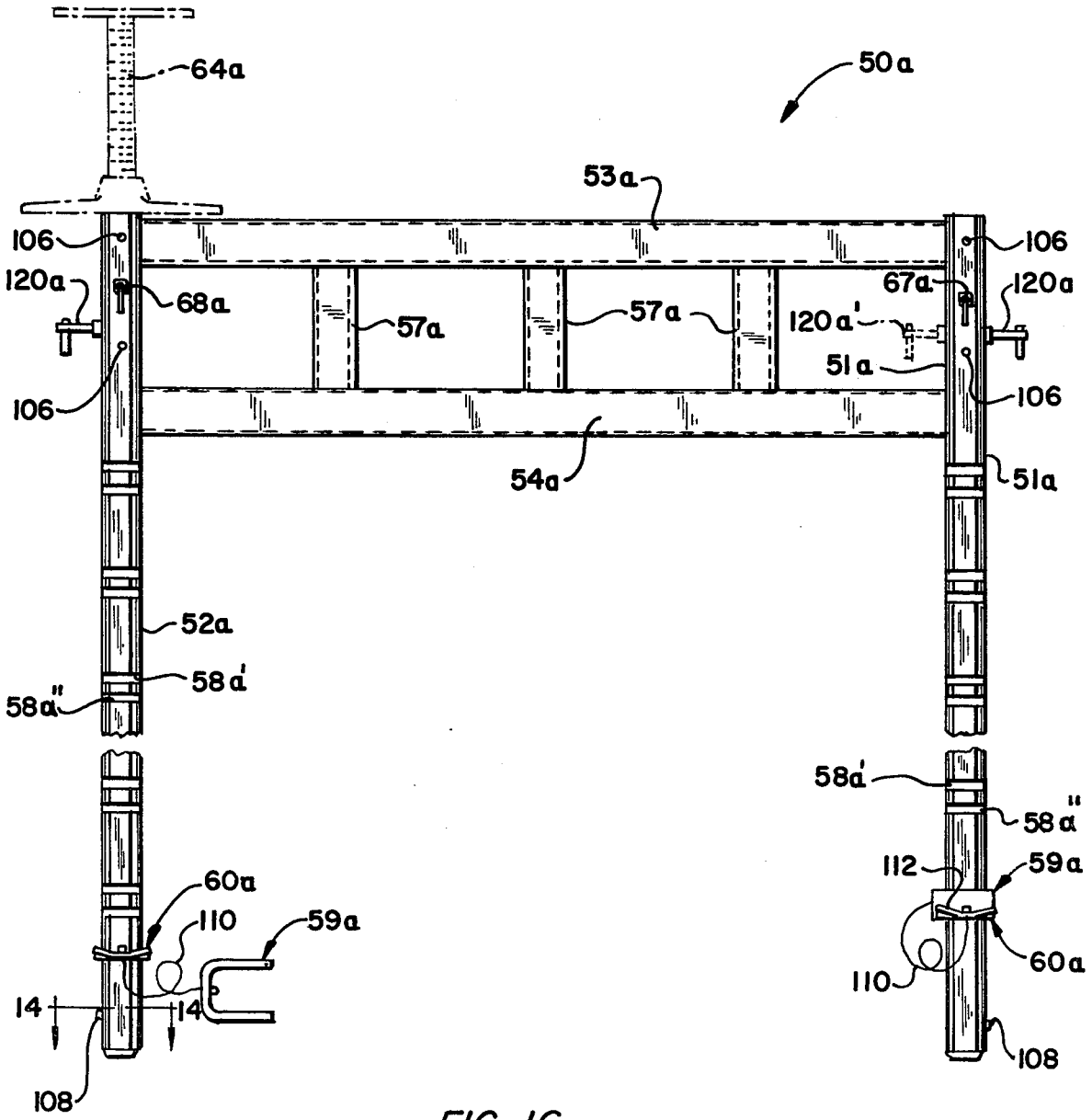
Figure 18:
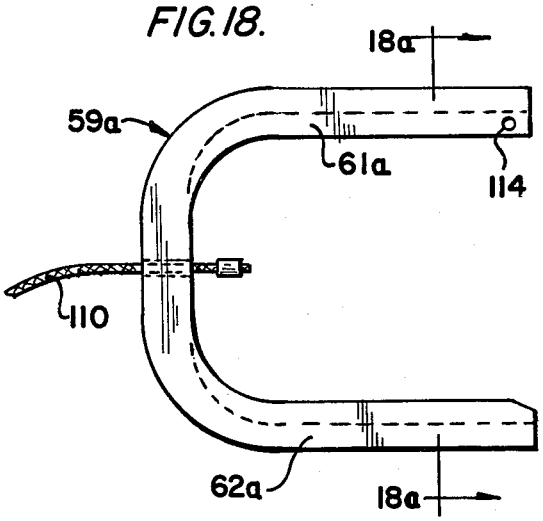
Figure 18A:
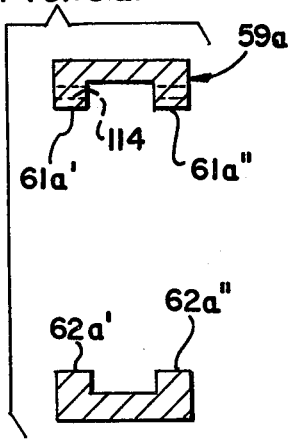
FIG. 18A is a cross section of the load collar taken on line 18A—18A of FIG. 18.
Figure 19:
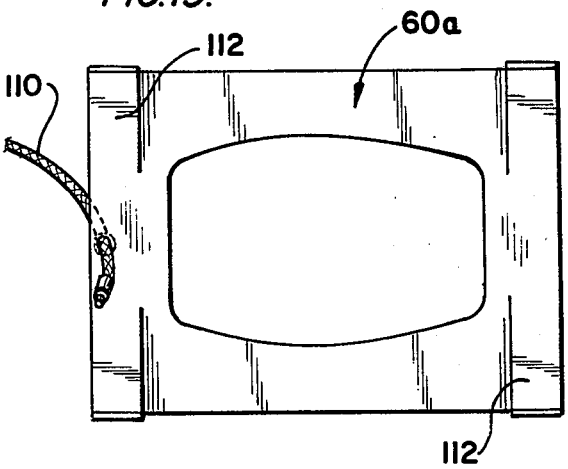
Figure 19A:
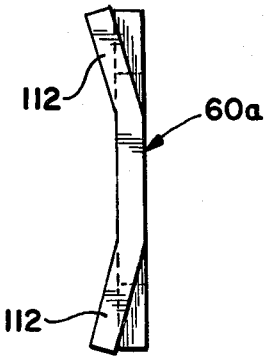

In FIG. 16, toggle bolt 120*a* has also been shown in dotted outline in an alternative position as bolt 120*a*' (which latter position has the advantage of being protected within the boundaries of the frame, rather than projecting outwardly and being subject to being knocked off).

What is claimed is:

1. In an extendable shoring system, the improvement comprising a hollow aluminum base leg having a uniform cross-section with walls shaped to give substantially greater lateral support in one direction than at right angles thereto, a hollow aluminum extension leg telescopically mounted to said base leg and have a plurality of transverse locating openings at spaced intervals along said extension leg, a plurality of support members in said locating openings engaging said base leg to fix said extension leg at a predetermined height on said base leg, and said locating openings being off-set sufficiently to permit a jack screw to be mounted on the extension leg without interference from said support members, said openings further being defined by slots in the sides of said extension leg, said support members being comprised of a U-shaped load collar having channels formed in the arms thereof defining rails adapted to fit in said slots, and a support plate positioned on top of said base leg for supporting said load collar and said extension leg and serving to spread the load from said support members to the walls of said base leg, said plate having retaining legs engaging said collar so as to prevent said collar from spreading open.

2. A device according to claim 1 wherein said leg adapted for use as a base leg has at least one longitudinally extending T-slot adapted to receive the head and a portion of the shank of a bolt.

3. A device according to claim 1, wherein said extension leg telescopes within the base leg and is relatively closely fitted therein to substantially conform to the interior portions of said base leg.

4. A device according to claim 3, wherein the shape of the base leg is substantially elliptical in cross-section.

5. A device according to claim 4, wherein the base leg and the extension leg are each respectively part of a two-legged shoring base frame and of a two-legged shoring extension frame, each frame having cross-supports.

6. A device according to claim 5 wherein each of the legs of said base frame have three longitudinally extending T-slots spaced at 90° intervals apart from said cross-support and from each other.

7. An extendable aluminum shoring system comprising base frames each having a pair of hollow, parallel, spaced legs and a plurality of spaced horizontal struts fixed to and extending between said legs, said base frame legs having a generally oval cross-section the minor axis of which lies in the plane of the base frame, a first recessed T-slot extending the length of each of said legs opposite said struts, two additional opposed T-slots at right angles to the first and also extending the length of each of said legs, extension frames each having a pair of hollow parallel extension legs and a plurality of horizontal struts interconnecting the tops of said extension legs, each of said extension legs telescoping in a close fit into an adjacent base frame leg, support means for holding each extension frame in one of several selected extended positions with respect to a respective adjacent base frame, end cross-braces for each of said extension frames, an upper end of each of said end cross-braces being removably fixed to a point on the upper end of the adjacent one of said extension frame legs, said end cross-braces being medially and pivotally connected, a lower end of each of said end cross-braces being adjustably secured to the adjacent one of said base frame legs by a bolt adjustably mounted in the adjacent one of said opposed T-slots, extension frame side cross-braces medially and pivotally interconnected and extending between horizontally spaced extension frames, an upper end of each of said extension frame side cross-braces being removably fixed to a point on the upper end of the adjacent one of said extension frame legs, a lower end of each of said extension frame side cross-braces being adjustably secured to the adjacent one of said base frame legs by a bolt adjustably mounted in said first T-slot, and base frame side cross-braces medially and pivotally interconnected and extending between horizontally spaced base frames with ends thereof removably fixed to points on the adjacent one of said base frame legs by fastening means positioned between said struts; said support means for holding said extension frames on said adjacent base frames comprising support plates each resting on a top of a respective base frame leg and around an extension frame leg passing freely therethrough, a U-shaped load collar resting on each such plate, the arms of said collar having a multiplicity of inner rails extending along the length of each of said arms, a series of sets of multiple slots in the sides of said extension legs with the sets being equally spaced therealong and with each set comprising at least two slots on either side of said extension leg. said slots accomodating said rails therein.

8. A system according to claim 7, further including for bottom ones of said base frame legs screw jacks mounted therein for leveling the shoring, and further including at the top of at least one said extension frame leg a screw jack mounted therein, without obstruction by said support means.

9. A system according to claim 8, further including at least one additional base frame vertically mounted on each adjacent one of said base frames and means for connecting said vertically mounted base frames.

* * * * *